US012455118B2

(12) United States Patent
Sobanski et al.

(10) Patent No.: US 12,455,118 B2
(45) Date of Patent: Oct. 28, 2025

(54) GRID ARRAYED MICROTUBE HEAT EXCHANGER WITH MIDSPAN SUPPORT COMPONENTS

(71) Applicant: RTX Corporation, Farmington, CT (US)

(72) Inventors: Jon Erik Sobanski, Glastonbury, CT (US); Jacob C. Snyder, East Haddam, CT (US)

(73) Assignee: RTX Corporation, Farmington, CT (US)

( * ) Notice: Subject to any disclaimer, the term of this patent is extended or adjusted under 35 U.S.C. 154(b) by 234 days.

(21) Appl. No.: 18/244,392

(22) Filed: Sep. 11, 2023

(65) Prior Publication Data

US 2025/0085060 A1 Mar. 13, 2025

(51) Int. Cl.
*F28D 7/16* (2006.01)

(52) U.S. Cl.
CPC ..... *F28D 7/163* (2013.01)

(58) Field of Classification Search
CPC ..... F28D 7/163; F28D 7/1607; F28D 7/06; F28F 2265/30
USPC ..... 165/172
See application file for complete search history.

(56) References Cited

U.S. PATENT DOCUMENTS 4,265,301 A 5/1981 Anderson
7,032,655 B2 * 4/2006 Wanni ..... F28F 9/013 165/172
7,267,164 B2 9/2007 Wanni et al.
7,506,684 B2 * 3/2009 Wanni ..... F28F 9/0132 248/68.1
7,699,093 B2 4/2010 Wanni et al.
7,793,708 B2 9/2010 Wanni et al.
9,488,419 B2 * 11/2016 Wanni ..... F28D 7/06
9,903,670 B2 * 2/2018 Cochran ..... F28F 9/005
10,935,232 B2 3/2021 Katayama et al.
2008/0245515 A1 * 10/2008 Wanni ..... F28D 7/1607 165/162
2016/0273845 A1 9/2016 Rizzi

FOREIGN PATENT DOCUMENTS

DE 102020105454 B4 11/2022
IT PD20070410 A1 6/2009

OTHER PUBLICATIONS

Extended European Search Report for counterpart EP Application No. 24198075 dated Feb. 24, 2025.

* cited by examiner

*Primary Examiner* — Jon T. Schermerhorn, Jr.
(74) *Attorney, Agent, or Firm* — Bachman & LaPointe, P.C.

(57) ABSTRACT

A grid arrayed microtube heat exchanger with vibration dampening support including an upper portion comprising an upper portion support wall having multiple upper portion receivers; a lower portion comprising a lower portion support wall having multiple lower portion receivers; a grid array comprising multiple rows of the lower portion receivers and the upper portion receivers; multiple microtubes supported by the upper portion receivers and the lower portion receivers; a gap located between each microtube; and a support insertable through the gap between the multiple microtubes, the support including at least one cam contacting the microtube, the at least one cam being rigid.

20 Claims, 6 Drawing Sheets

GRID ARRAYED MICROTUBE HEAT EXCHANGER WITH MIDSPAN SUPPORT COMPONENTS

BACKGROUND

The present disclosure is directed to a grid arrayed microtube heat exchanger with a midspan support.

Microtube heat exchangers work by having an array of very small tubes which have a working fluid pumped within them. Each end of the tube is fixed to a rigid manifold which helps to accommodate the working fluid and acts as a mounting location. The exterior of the tubes have a different working fluid (air/oil/water/etc.) which passes over the exterior of the tubes to transfer thermal energy between the working fluids. Microtube heat exchangers are heat exchangers in which (at least one) fluid flows in lateral confinements with typical dimensions below 1 mm. The most typical such confinement are microchannels, which are channels with a hydraulic diameter below 1 mm. The microtube heat exchangers can include tubes with diameters that range from 1 micrometer to 1000 micrometer. Microtube heat exchangers can be made from metal or ceramic. There are numerous design, manufacturing, cost, and structural constraints associated with this type of concept. However, one key structural concern is managing vibration and high cycle fatigue.

What is needed is a grid arrayed microtube heat exchanger with a midspan support that can preload the microtubes.

SUMMARY

In accordance with the present disclosure, there is provided a grid arrayed microtube heat exchanger with vibration dampening support comprising an upper portion comprising an upper portion support wall having multiple upper portion receivers; a lower portion comprising a lower portion support wall having multiple lower portion receivers; a grid array comprising multiple rows of the lower portion receivers and the upper portion receivers; multiple microtubes supported by the upper portion receivers and the lower portion receivers; a gap located between each microtube; and a support insertable through the gap between the multiple microtubes, the support including at least one cam contacting the microtube, the at least one cam being rigid.

A further embodiment of any of the foregoing embodiments may additionally and/or alternatively include the at least one cam being formed on the support as an opposed pair of cams.

A further embodiment of any of the foregoing embodiments may additionally and/or alternatively include a size of a height of the at least one cam being configured to maintain forces on each of the multiple microtubes within an elastic regime of the multiple microtubes.

A further embodiment of any of the foregoing embodiments may additionally and/or alternatively include the at least one cam being sized to influence the multiple microtubes up to a steady state stress point.

A further embodiment of any of the foregoing embodiments may additionally and/or alternatively include the at least one cam resists deflection upon contacting the microtube.

A further embodiment of any of the foregoing embodiments may additionally and/or alternatively include the support being inserted at about a midspan of the microtube heat exchanger between adjacent multiple microtubes supported by the upper portion receivers and lower portion receivers.

A further embodiment of any of the foregoing embodiments may additionally and/or alternatively include the grid arrayed microtube heat exchanger with vibration dampening support further comprising a locking clip attached to the support, the locking clip configured to prevent movement of the support.

In accordance with the present disclosure, there is provided a grid arrayed microtube heat exchanger with vibration dampening support comprising an upper portion comprising an upper portion support wall having multiple upper portion receivers; a lower portion comprising a lower portion support wall having multiple lower portion receivers; a grid array comprising multiple rows of the lower portion receivers and upper portion receivers; multiple microtubes supported by the upper portion receivers and the lower portion receivers; a gap located between pairs of the multiple microtubes, the gap configured for a line-of-sight spacing between each of the multiple microtubes; and a support insertable through the gap between the pairs of the multiple microtubes, the support including at least one cam contacting the each microtube in the pairs of the multiple microtubes, the at least one cam being rigid.

A further embodiment of any of the foregoing embodiments may additionally and/or alternatively include the support being inserted at about a midspan of the microtube heat exchanger between adjacent multiple microtubes supported by the upper portion receivers and lower portion receivers.

A further embodiment of any of the foregoing embodiments may additionally and/or alternatively include the support being located between the multiple microtubes at a location between the upper portion and the lower portion that corresponds with the natural frequency of the multiple microtubes.

A further embodiment of any of the foregoing embodiments may additionally and/or alternatively include the support being located between the multiple microtubes at a location between the upper portion and the lower portion that corresponds with from about ⅓ to about ⅔ the span of the multiple microtubes between the upper portion and the lower portion.

A further embodiment of any of the foregoing embodiments may additionally and/or alternatively include the support contacts the multiple microtubes responsive to a preload of the multiple microtubes.

A further embodiment of any of the foregoing embodiments may additionally and/or alternatively include the support comprises a body having a longitudinal portion between a first handle and a second handle, the first handle formed integral to the body at a first end, the second handle formed integral to the body at a second end opposite the first end, the at least one cam protrude from the longitudinal portion integrally formed in the body, the at least one cam being located on a first face of the longitudinal portion and another at least one cam being located on a second face opposite the first face.

In accordance with the present disclosure, there is provided a process for vibration dampening a grid arrayed microtube heat exchanger with a support comprising an upper portion comprising an upper portion support wall having multiple upper portion receivers; a lower portion comprising a lower portion support wall having multiple lower portion receivers; a grid array comprising multiple rows of the lower portion receivers and upper portion receivers; supporting multiple microtubes by the upper portion receivers and the lower portion receivers; forming a gap located between pairs of the multiple microtubes; configuring the gap with a line-of-sight spacing between each of the multiple microtubes; inserting a support through the gap between the pairs of the multiple microtubes; and contacting each of the multiple microtubes with a cam formed in the support, the at least one cam being rigid.

A further embodiment of any of the foregoing embodiments may additionally and/or alternatively include the process further comprising inserting the support at about a midspan of the microtube heat exchanger between adjacent multiple microtubes supported by the upper portion receivers and lower portion receivers.

A further embodiment of any of the foregoing embodiments may additionally and/or alternatively include the process further comprising preloading the multiple microtubes responsive to contacting the multiple microtubes with the cam, wherein the preloading dampens vibration created by fluid dynamic forces flowing between the multiple microtubes.

A further embodiment of any of the foregoing embodiments may additionally and/or alternatively include the process further comprising sizing of a height of the cam to maintain forces on each of the multiple microtubes within an elastic regime of the multiple microtubes.

A further embodiment of any of the foregoing embodiments may additionally and/or alternatively include the process further comprising sizing the cam to influence the multiple microtubes up to a steady state stress point.

A further embodiment of any of the foregoing embodiments may additionally and/or alternatively include the process further comprising aligning pairs of the cam with matching pairs of the multiple microtubes.

A further embodiment of any of the foregoing embodiments may additionally and/or alternatively include the process further comprising attaching a locking clip to the support; and configuring the locking clip to prevent movement of the support.

Other details of the grid arrayed microtube heat exchanger with a midspan support are set forth in the following detailed description and the accompanying drawings wherein like reference numerals depict like elements.

DETAILED DESCRIPTION

Figure 1:
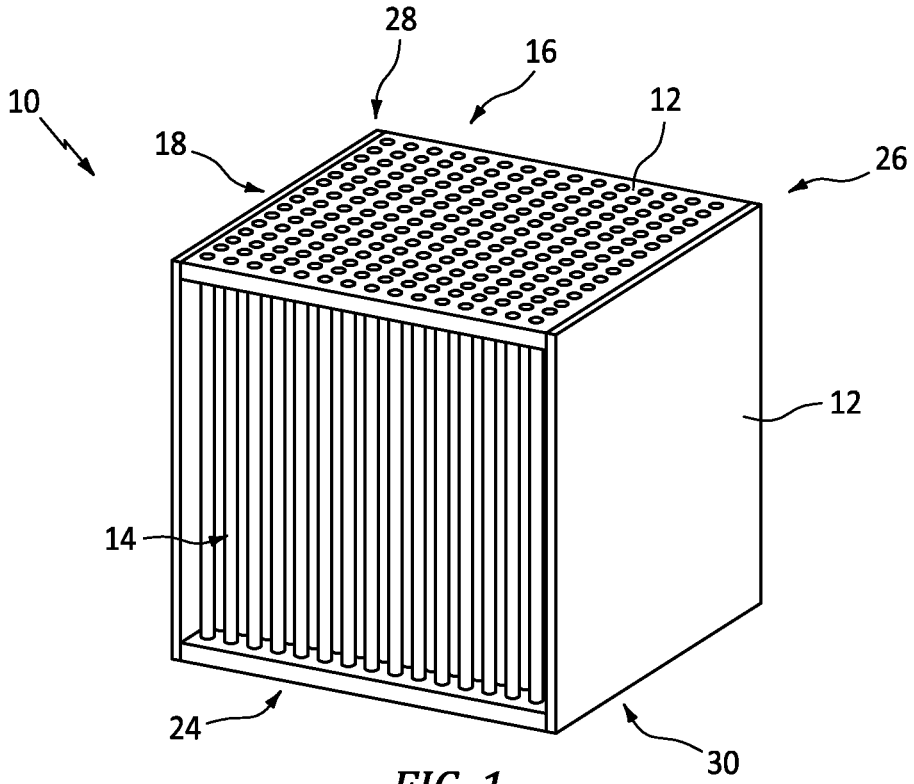
FIG. 1 is an isometric view schematic representation of an exemplary grid arrayed microtube heat exchanger.
Figure 2:
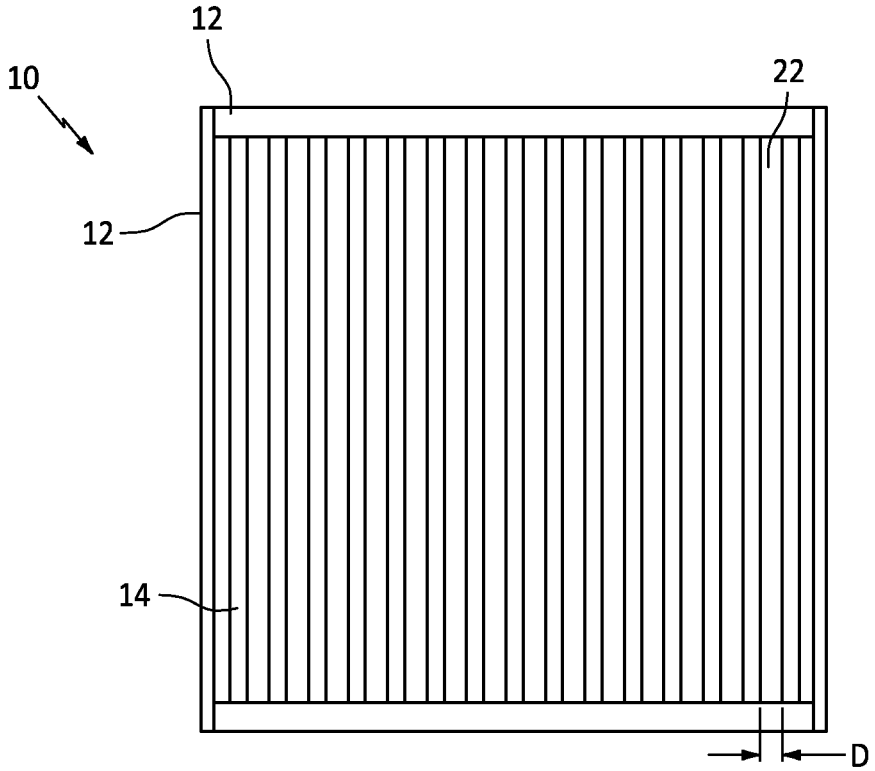
FIG. 2 is a cross-section view schematic representation of an exemplary grid arrayed microtube heat exchanger.
Figure 3:
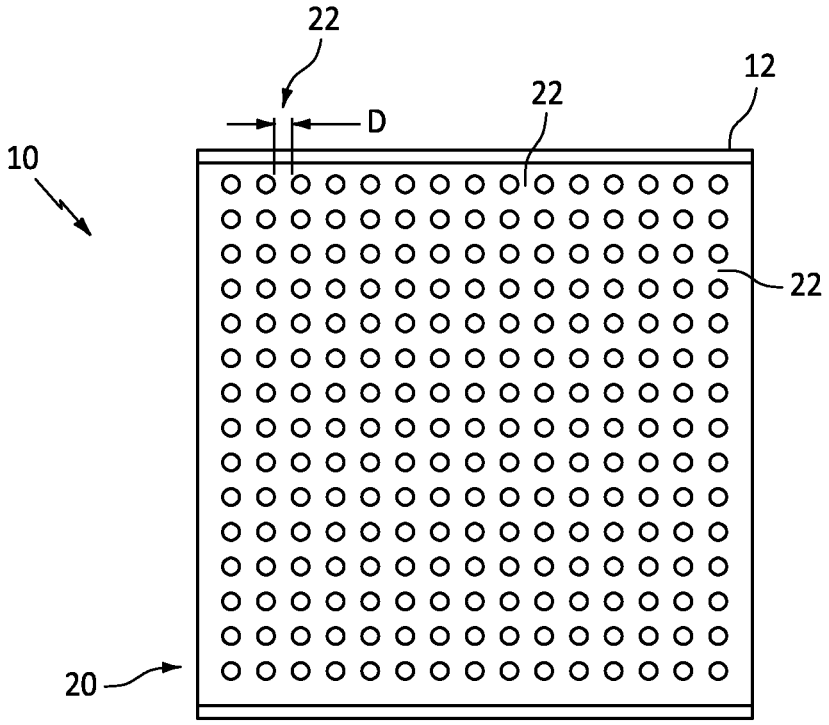
FIG. 3 is a plan view schematic representation of an exemplary grid arrayed microtube heat exchanger.

Referring now to FIG. 1, FIG. 2, FIG. 3, there are illustrated an exemplary grid arrayed microtube heat exchanger 10. The microtube heat exchanger 10 includes support walls 12 that provide support to microtubes 14. The support wall 12 includes receivers 16 that support the microtubes 14. The receivers 16 are arranged into a grid array 18 that locates the microtubes 14 into rows 20 that form a gap 22 between each microtube 14. The rows 20 are spaced apart by the gap 22 a distance D that allows for a line-of-sight spacing between the rows 20 and thus, the microtubes 14. The gap 22 does not have to be symmetrical throughout the heat exchanger 10, as long as the nominal dimension allows for a line-of-sight gap 22. Some of the microtubes 14 can be misaligned or staggered to some degree and still maintain a line-of-sight gap 22.

The figures illustrate a uniform grid layout for the grid array 18, however, there is capacity to allow for variation between the rows 20 and gap 22 sizes.

The grid array 18 places the microtubes 14 in a substantially uniform grid layout (rather than a staggered arrangement). As such, there is a clear line-of-site gap 22 from the front 24 the heat exchanger 10 to the rear 26 between adjacent microtubes 14. The microtubes 14 span between an upper portion 28 and a lower portion 30 of the heat exchanger 10. The span between the upper portion 28 and the lower portion 30 can be bisected at a midspan 34 location.

Figure 4:
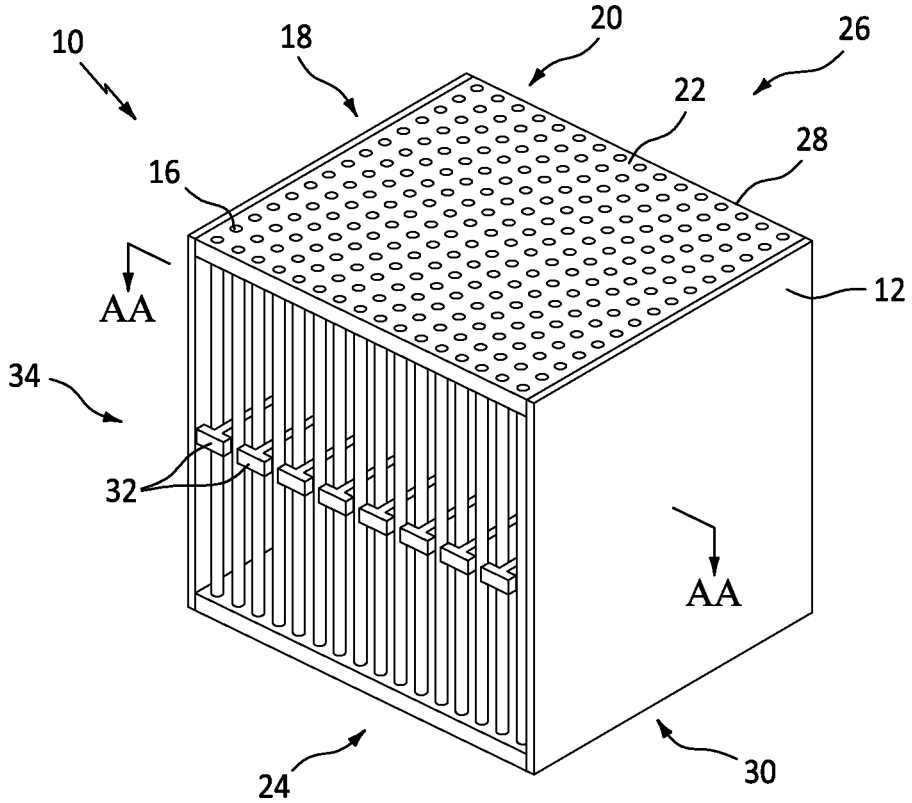
FIG. 4 is an isometric view schematic representation of an exemplary grid arrayed microtube heat exchanger with midspan supports.
Figure 5:
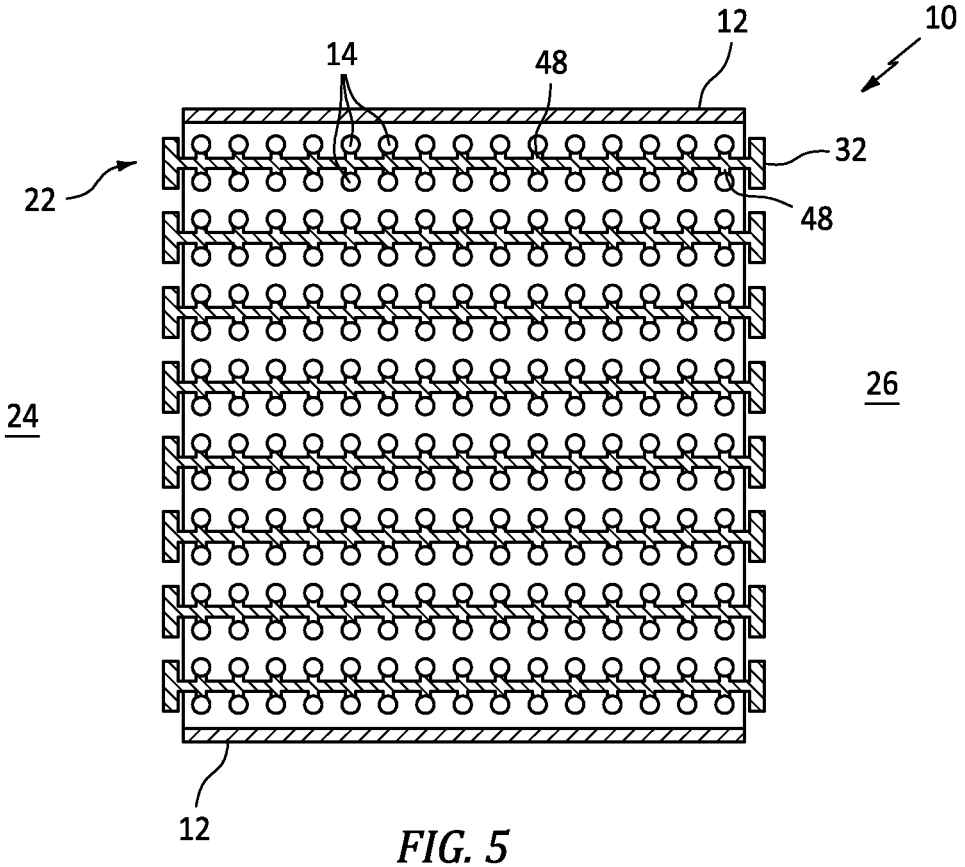
FIG. 5 is a plan view of cross-section AA schematic representation of an exemplary grid arrayed microtube heat exchanger with midspan supports of FIG. 4.
Figure 6:
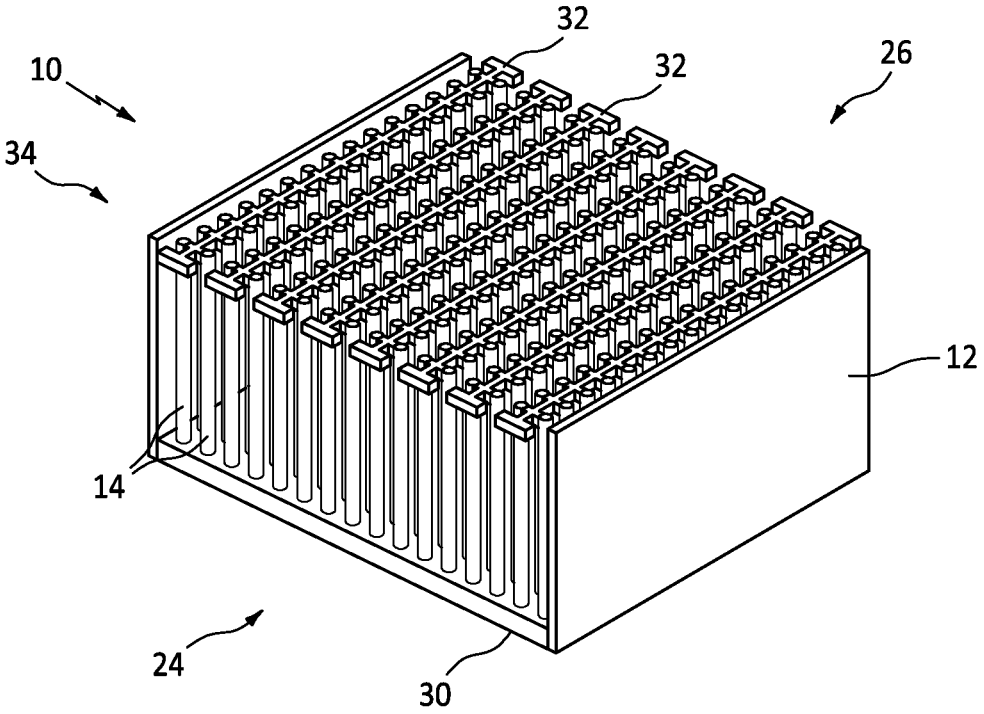
FIG. 6 is an isometric view of cross-section AA schematic representation of an exemplary grid arrayed microtube heat exchanger with midspan supports of FIG. 4.

Also referring to FIG. 4 through FIG. 6, at least one midspan support or simply support 32 can be inserted at about the midspan 34 of the heat exchanger 10 between adjacent microtubes 14. The midspan 34 can be located approximately half-way between the upper portion 28 and the lower portion 30 of the heat exchanger 10. In exemplary embodiment, the support 32 can be located between the microtubes 14 at a location between the upper portion 28 and the lower portion 30 that corresponds with the natural frequency of the microtube 14. In exemplary embodiment, the support 32 can be located between the microtubes 14 at a location between the upper portion 28 and the lower portion 30 that corresponds with a first order magnitude frequency approximately at 50% of the span of the microtube 32 between the upper portion 28 and lower portion 30. In exemplary embodiment, the support 32 can be located between the microtubes 14 at a location between the upper portion 28 and the lower portion 30 that corresponds with from about ⅓ to about ⅔ the span of the microtube 32 between the upper portion 28 and lower portion 30.

In exemplary embodiments, the support 32 can be inserted and contact the microtubes 14 to preload the microtubes 14 in opposite directions. The support 32 can be paired with two adjacent neighboring microtubes 14, such that the support 32 is located in the gap 22 between the microtubes 14.

Figure 7:
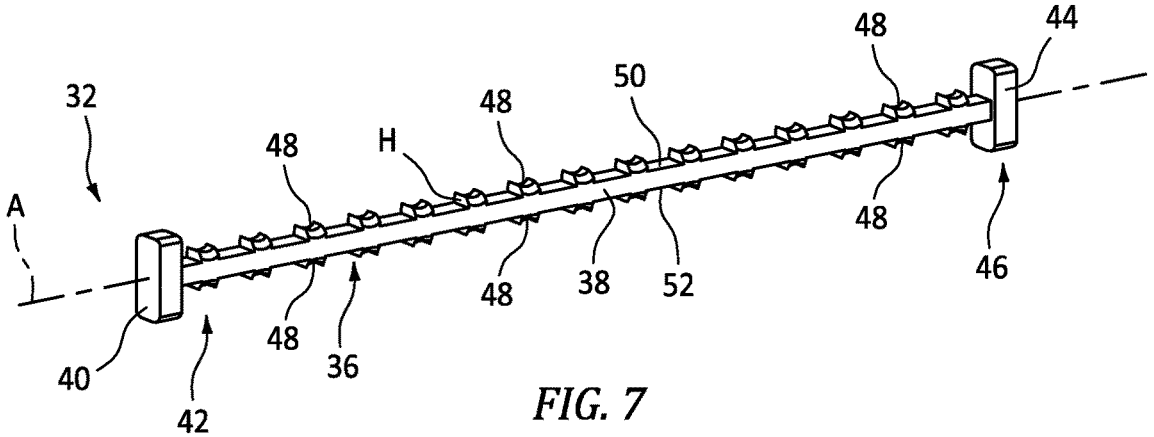
FIG. 7 is a schematic representation of an exemplary midspan support.
Figure 8:
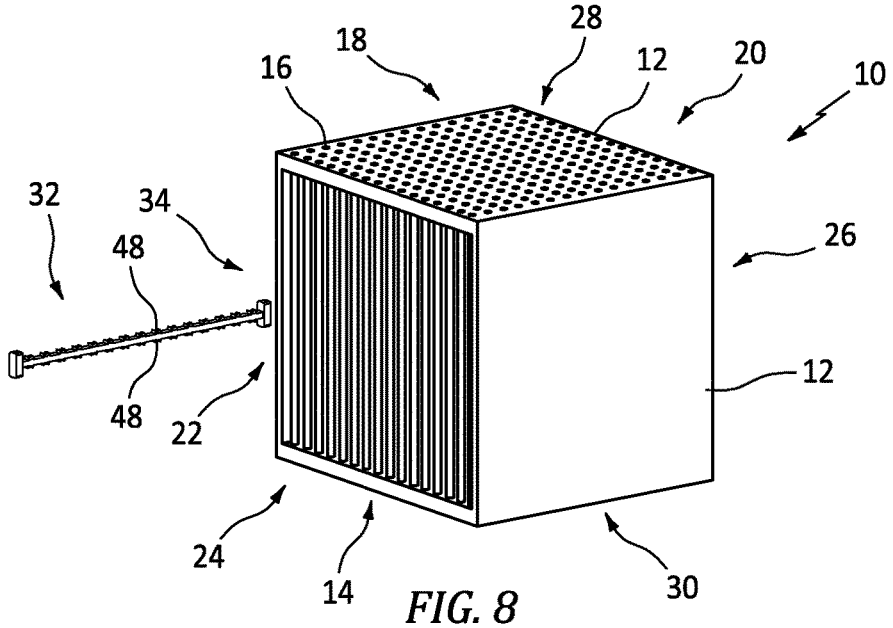
FIG. 8 is a schematic representation of an exemplary midspan support insertion into an exemplary grid arrayed microtube heat exchanger.
Figure 9:
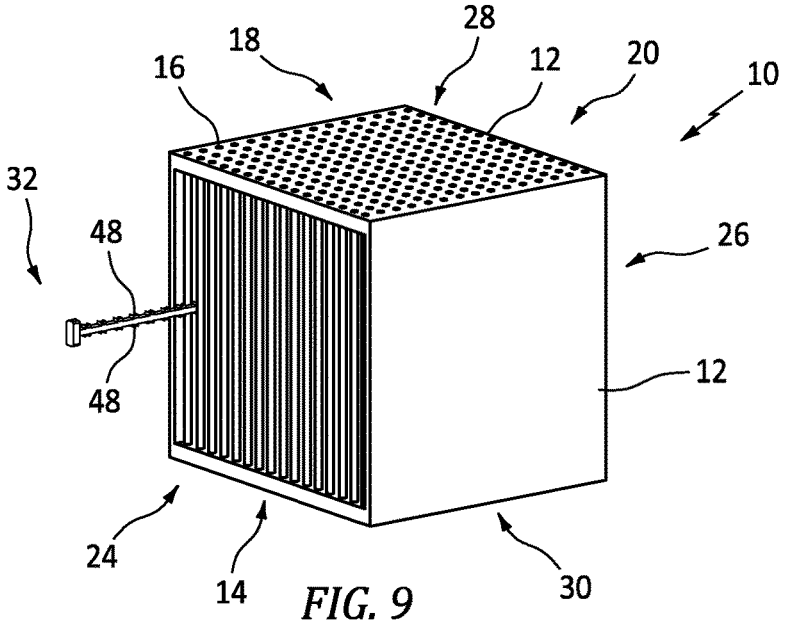
FIG. 9 is a schematic representation of an exemplary midspan support insertion into an exemplary grid arrayed microtube heat exchanger.
Figure 10:
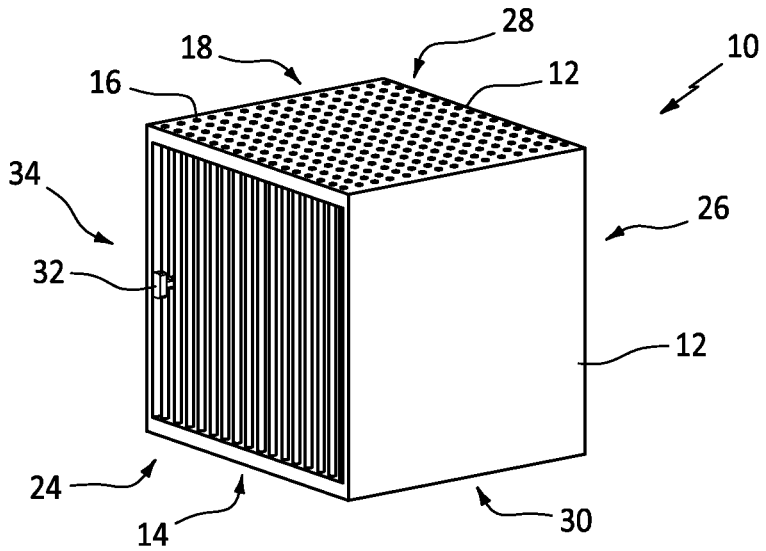
FIG. 10 is a schematic representation of an exemplary midspan support inserted into an exemplary grid arrayed microtube heat exchanger.
Figure 11:
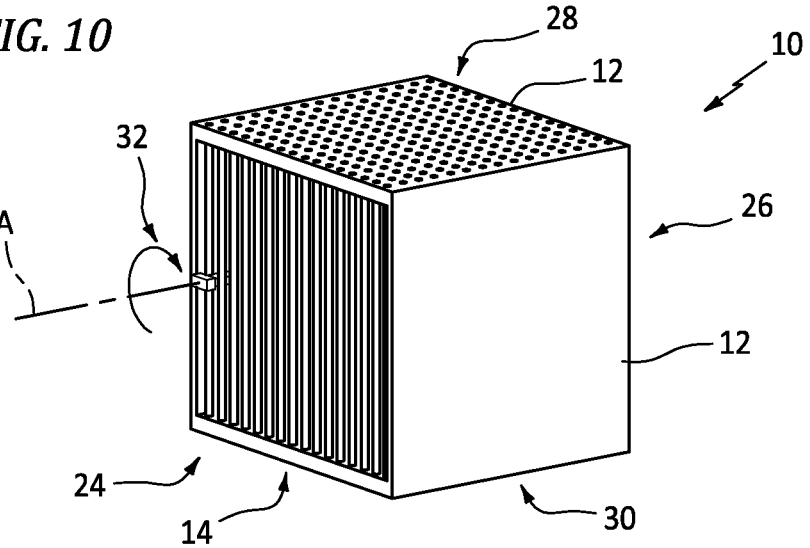
FIG. 11 is a schematic representation of an exemplary midspan support inserted into an exemplary grid arrayed microtube heat exchanger.

Referring also to FIG. 7, an exemplary support 32 is shown. The support 32 can include a body 36 having a longitudinal portion 38. The longitudinal portion 38 can be formed as a rectilinear shaped object, or other shaped cross-sections. The body 36 can have a length that extends across the tube bundle grid array 18 through a gap 22 from the front 24 to the rear 26. The support 32 can be constructed from but not limited to lubricious metal materials, standard metal materials, and composite materials.

A first handle 40 is formed integral to the body 36 at a first end 42. A second handle 44 is formed integral to the body 36 at a second end 46 opposite the first end 42 as shown. The first handle 40 and second handle 44 are configured to be manipulated and resist tension, compression and torsional forces responsive to the support 32 being inserted along and turned about a longitudinal axis A in between the microtubes 14. The handles 40, 44 are configured to be turned in order to rotate the body 36 between the microtubes 14.

The body 36 can include cam features or simply cam(s) 48 that protrude from the longitudinal portion 38. The cam(s) 48 can be integrally formed in the body 36. In an exemplary embodiment, the cam 48 can be located on a first face 50 of the longitudinal portion 38 and another cam 48 can be located on a second face 52 opposite the first face 50, so that the cams 48 are opposite each other. The cams 48 can be formed on the support 32 as an opposed pair. By locating cam(s) 48 on opposite sides of the body 36, the forces that are applied to the body 36 by each microtube 14 are cancelled out and less stress to the body 36 orthogonal to the axis A is encountered. The opposing cams 48 can provide greater leverage when contacting the microtubes 14.

The cam(s) 48 can include a height dimension H that extends from the face 50, 52. The height H of the cam 48 can be related to the amount of deflection desired in the microtube 14 responsive to the contact and subsequent pre-loading force being applied by the cam 48 to the microtube 14. The size of the height H can be formed in order to maintain forces on the microtube 14 that stays within the elastic regime of the microtube 14. If the cam 48 is too tall, the height H dimension upon engagement of the cam may cause the microtube 14 to deflect beyond the elastic regime, plastically deform the microtube 14 and cause damage to the life of the microtube 14. If the cam 48 is too short, the height H dimension upon engagement of the cam 48 will not deflect the microtube 14 sufficiently enough to dampen the unwanted vibration. In an exemplary embodiment, the cam 48 can be sized to influence the microtube 14 up to a steady state stress point.

The support 32 can have a different coefficient of thermal expansion than the microtube 14. This difference in coefficient of thermal expansion can be beneficial to maintaining preload between the cams 48 and the microtube 14 during thermal transients. Where the difference in coefficient of thermal expansion aids in applying preload to the tubes 14. This prevents wear or vibratory excitement over the life of the components.

The cam 48 is a relatively rigid structure. The cam 48 does not deflect upon contacting the microtube 14 when engaged to perform the vibration dampening function. The cam 48 can be a solid portion of the body 36. In an exemplary embodiment, the cam 48 can have hollow portions, so long as the cam 48 can maintain the rigid stiff characteristics, and does not collapse in response to pressure from the microtube 14. It is contemplated that it may not be necessary for every microtube 14 in the tube array 18 be contacted by a cam 48.

Figure 12:
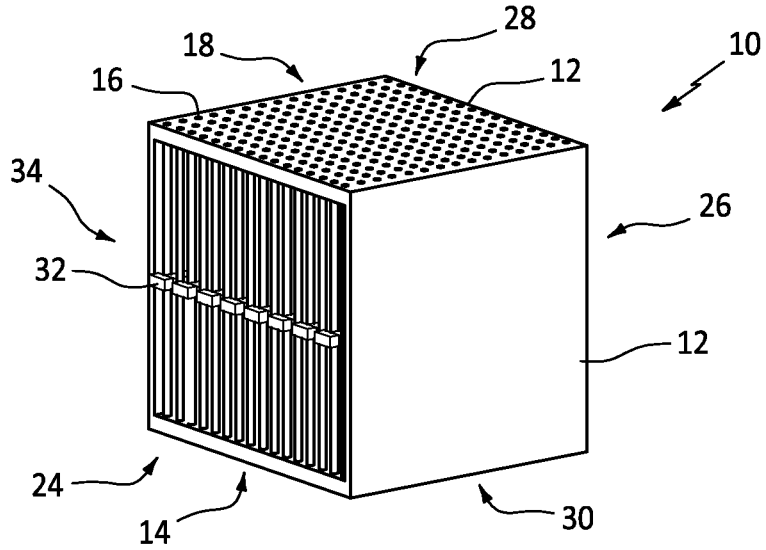
FIG. 12 is a schematic representation of multiple exemplary midspan supports inserted into an exemplary grid arrayed microtube heat exchanger.

Referring also to FIG. 8 to FIG. 13, the process of engaging the support 32 with the microtube 14 is shown. At FIG. 8 the support 32 is shown exterior of the microtube heat exchanger 10. The support 32 is to be inserted into the gap 22 between the rows 20 of the microtubes 14. The handles 40, 42 can be oriented upward such that the second handle 44 upon insertion into the gap 22, will pass through the gap 22 between the adjacent microtubes 14 without interference from the microtubes 14. The cams 48 along the longitudinal portion can also pass along through the microtube heat exchanger 10 without contacting the microtubes 14. The support 32 is inserted through the front end 24 and toward the rear end 26 at approximately the midspan 34 of the microtubes 14. Upon full insertion of the support 32 the first handle 40 can be proximate the front end 24 and the microtubes 14 closest to the front 24. The second handle 44 can be extended beyond the microtube 14 proximate the rear 26. Each cam 48 can be positioned adjacent a microtube 14 within the microtube heat exchanger 10. The support 32 can be rotated about the axis A. The rotation of the support 32 initiates contact between each cam 48 and adjacent microtube 14. Further rotation of the support 32 can place the cam 48 into full contact with the microtube 14 and subsequent preloaded condition. Each support 32 can be inserted into the microtube heat exchanger 10 into the gaps 22 with the cams 48 aligned with matching pairs of microtubes 14 as seen in FIG. 5, FIG. 6 and FIG. 12.

Figure 13:
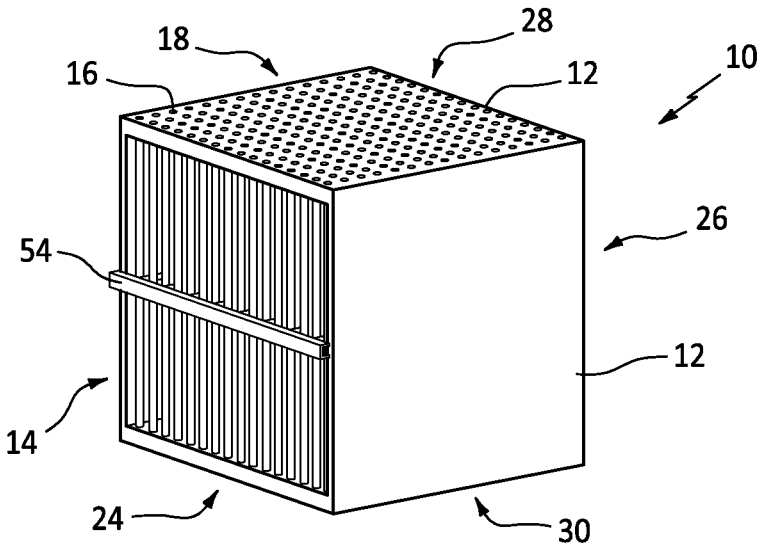
FIG. 13 is a schematic representation of multiple exemplary midspan supports inserted into an exemplary grid arrayed microtube heat exchanger with locking feature.

A locking clip 54 can be attached to the first handles 40 of the supports 32 as seen in FIG. 13. The locking clip 54 can be configured to engage the handles 40, 44 in such an arrangement so as to prevent unwanted movement of the supports 32, such as rotation. A tung and groove arrangement, a slotted channel, a D-channel and the like can be employed with the clip 54 to engage the support 32 at the handles 40, 44.

Figure 14:
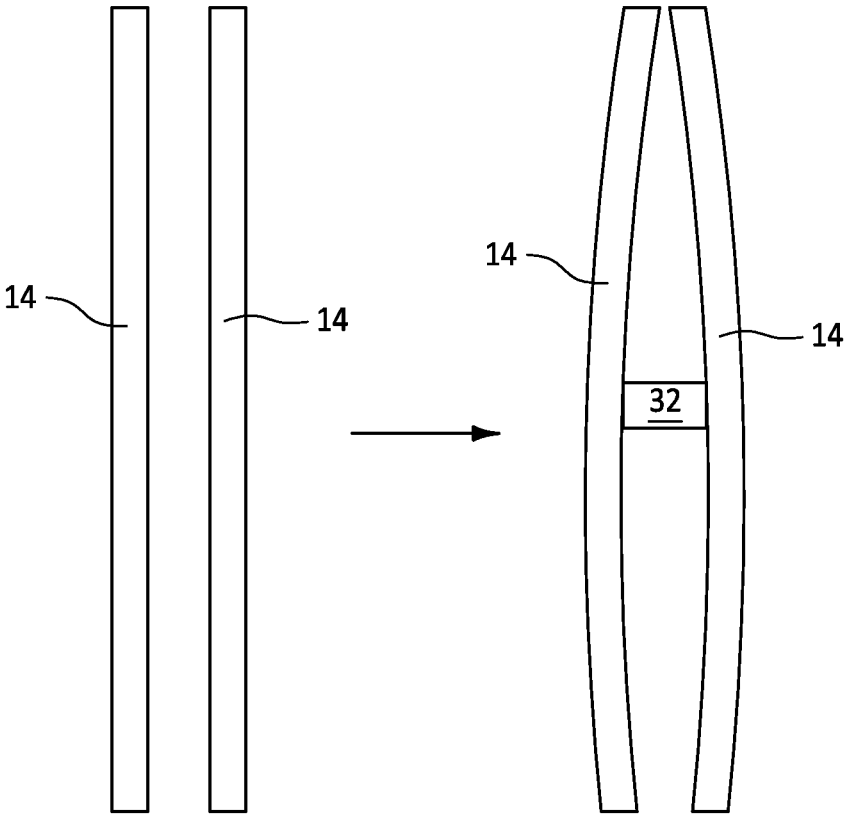
FIG. 14 is a schematic diagram of a before and after representation of a midspan support preloading microtubes.

Referring also to FIG. 14, the illustration demonstrates the preloading concept disclosed herein. The pair of microtubes 14 are shown on the left hand side of FIG. 14 without a support 32. The pair of microtubes on the right hand side of FIG. 14 shows a support 32 inserted between the microtubes 14 and in a preloaded position applying a cam force on the microtubes 14. The FIG. 14 microtube 14 is shown as deflecting or bending across the length of the microtube 14. Preloading the microtubes 14 dampens the vibration created by fluid dynamic forces flowing between the microtubes 14 during operation of the microtube heat exchanger 10. It has been demonstrated that by inserting the support 32 and preloading the microtubes 14, the unwanted vibration can be dampened and thus mitigated.

A technical advantage of the disclosed grid arrayed microtube heat exchanger with midspan support includes reduced vibratory excitement of the microtubes by utilizing a dampener support located near the midspan of the tube array.

Another technical advantage of the disclosed grid arrayed microtube heat exchanger with midspan support includes an easy to install mechanism to prevent unwanted vibration.

Another technical advantage of the disclosed grid arrayed microtube heat exchanger with midspan support includes a consistent mechanism to apply preloading to the tube array to prevent high vibration.

Another technical advantage of the disclosed grid arrayed microtube heat exchanger with midspan support includes a mechanism to customize the preloading forces to the tube array.

There has been provided a grid arrayed microtube heat exchanger with a midspan support. While the grid arrayed microtube heat exchanger with a midspan support has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A grid arrayed microtube heat exchanger with vibration dampening support comprising:

an upper portion comprising an upper portion support wall having multiple upper portion receivers;

a lower portion comprising a lower portion support wall having multiple lower portion receivers;

a grid array comprising multiple rows of the lower portion receivers and the upper portion receivers;

multiple microtubes supported by the upper portion receivers and the lower portion receivers;

a gap located between each microtube; and a support insertable through the gap between the multiple microtubes, the support including at least one cam contacting the microtube, the at least one cam being rigid.

2. The grid arrayed microtube heat exchanger with vibration dampening support according to claim 1, wherein the at least one cam being formed on the support as an opposed pair of cams.

3. The grid arrayed microtube heat exchanger with vibration dampening support according to claim 1, wherein a size of a height of the at least one cam being configured to maintain forces on each of the multiple microtubes within an elastic regime of the multiple microtubes.

4. The grid arrayed microtube heat exchanger with vibration dampening support according to claim 1, wherein the at least one cam being sized to influence the multiple microtubes up to a steady state stress point.

5. The grid arrayed microtube heat exchanger with vibration dampening support according to claim 1, wherein the at least one cam resists deflection upon contacting the microtube.

6. The grid arrayed microtube heat exchanger with vibration dampening support according to claim 1, wherein the support being inserted at about a midspan of the microtube heat exchanger between adjacent multiple microtubes supported by the upper portion receivers and lower portion receivers.

7. The grid arrayed microtube heat exchanger with vibration dampening support according to claim 1, further comprising:

a locking clip attached to the support, the locking clip configured to prevent movement of the support.

8. A grid arrayed microtube heat exchanger with vibration dampening support comprising:

an upper portion comprising an upper portion support wall having multiple upper portion receivers;

a lower portion comprising a lower portion support wall having multiple lower portion receivers;

a grid array comprising multiple rows of the lower portion receivers and upper portion receivers;

multiple microtubes supported by the upper portion receivers and the lower portion receivers;

a gap located between pairs of the multiple microtubes, the gap configured for a line-of-sight spacing between each of the multiple microtubes; and a support insertable through the gap between the pairs of the multiple microtubes, the support including at least one cam contacting the each microtube in the pairs of the multiple microtubes, the at least one cam being rigid.

9. The grid arrayed microtube heat exchanger with vibration dampening support according to claim 8, wherein the support being inserted at about a midspan of the microtube heat exchanger between adjacent multiple microtubes supported by the upper portion receivers and lower portion receivers.

10. The grid arrayed microtube heat exchanger with vibration dampening support according to claim 8, wherein the support being located between the multiple microtubes at a location between the upper portion and the lower portion that corresponds with the natural frequency of the multiple microtubes.

11. The grid arrayed microtube heat exchanger with vibration dampening support according to claim 8, wherein the support being located between the multiple microtubes at a location between the upper portion and the lower portion that corresponds with from about ⅓ to about ⅔ the span of the multiple microtubes between the upper portion and the lower portion.

12. The grid arrayed microtube heat exchanger with vibration dampening support according to claim 8, wherein the support contacts the multiple microtubes responsive to a preload of the multiple microtubes.

13. The grid arrayed microtube heat exchanger with vibration dampening support according to claim 8, wherein the support comprises a body having a longitudinal portion between a first handle and a second handle, the first handle formed integral to the body at a first end, the second handle formed integral to the body at a second end opposite the first end, the at least one cam protrude from the longitudinal portion integrally formed in the body, the at least one cam being located on a first face of the longitudinal portion and another at least one cam being located on a second face opposite the first face.

14. A process for vibration dampening a grid arrayed microtube heat exchanger with a support comprising:

an upper portion comprising an upper portion support wall having multiple upper portion receivers;

a lower portion comprising a lower portion support wall having multiple lower portion receivers;

a grid array comprising multiple rows of the lower portion receivers and upper portion receivers;

supporting multiple microtubes by the upper portion receivers and the lower portion receivers;

forming a gap located between pairs of the multiple microtubes;

configuring the gap with a line-of-sight spacing between each of the multiple microtubes;

inserting a support through the gap between the pairs of the multiple microtubes; and contacting each of the multiple microtubes with a cam formed in the support, the at least one cam being rigid.

15. The process of claim 14, further comprising:

inserting the support at about a midspan of the microtube heat exchanger between adjacent multiple microtubes supported by the upper portion receivers and lower portion receivers.

16. The process of claim 14, further comprising:

preloading the multiple microtubes responsive to contacting the multiple microtubes with the cam, wherein the preloading dampens vibration created by fluid dynamic forces flowing between the multiple microtubes.

17. The process of claim 14, further comprising:

sizing of a height of the cam to maintain forces on each of the multiple microtubes within an elastic regime of the multiple microtubes.

18. The process of claim 14, further comprising:

sizing the cam to influence the multiple microtubes up to a steady state stress point.

19. The process of claim 14, further comprising:

aligning pairs of the cam with matching pairs of the multiple microtubes.

20. The process of claim 19, further comprising:

attaching a locking clip to the support; and configuring the locking clip to prevent movement of the support.

* * * * *